US008451196B2

(12) United States Patent
Park et al.

(10) Patent No.: US 8,451,196 B2
(45) Date of Patent: May 28, 2013

(54) ORGANIC LIGHT EMITTING DIODE DISPLAY DEVICE AND METHOD OF AGING THE SAME

(75) Inventors: Hye-Hyang Park, Suwon-si (KR); Sun-A Yang, Suwon-si (KR)

(73) Assignee: Samsung Display Co., Ltd., Giheung-Gu, Yongin, Gyeonggi-Do (KR)

( * ) Notice: Subject to any disclaimer, the term of this patent is extended or adjusted under 35 U.S.C. 154(b) by 1519 days.

(21) Appl. No.: 12/068,030

(22) Filed: Jan. 31, 2008

(65) Prior Publication Data

US 2008/0186301 A1 Aug. 7, 2008

(30) Foreign Application Priority Data

Feb. 1, 2007 (KR) ..... 10-2007-0010514

(51) Int. Cl.
*G09G 3/30* (2006.01)

(52) U.S. Cl.
USPC ..... 345/76; 345/80; 345/77; 345/690; 345/211; 345/82; 315/169.3

(58) Field of Classification Search
USPC ..... 345/76–83, 204–211, 690; 315/169.3; 327/108–112; 313/483, 486, 500, 505–507; 326/82–83
See application file for complete search history.

(56) References Cited

U.S. PATENT DOCUMENTS

2002/0113760 A1* 8/2002 Kimura ..... 345/82
2003/0112205 A1* 6/2003 Yamada ..... 345/32
2003/0160745 A1* 8/2003 Osame et al. ..... 345/82
2004/0041750 A1* 3/2004 Abe ..... 345/76
2004/0169622 A1* 9/2004 Matsuura et al. ..... 345/76

(Continued)

FOREIGN PATENT DOCUMENTS

KR 10-2002-0080326 10/2002
KR 10-2004-0060024 7/2004

(Continued)

OTHER PUBLICATIONS

*Notice of Allowability* from the Korean Patent Office issued in Applicant's corresponding Korean Patent Application No. 2007-0010514 dated Jun. 19, 2008.

*Primary Examiner* — Lun-Yi Lao
*Assistant Examiner* — Priyank Shah
(74) *Attorney, Agent, or Firm* — Robert E. Bushnell, Esq.

(57) ABSTRACT

An organic light emitting diode (OLED) display device and a method for aging the organic light emitting diode (OLED) display device. The OLED display device is constructed with an organic light emitting diode, a scan line for applying a scan signal, a data line for applying a data signal, a driving unit for applying the data signal in response to the scan signal, a driving transistor having a gate terminal electrically connected to the driving unit to supply a driving current to the organic light emitting diode in response to the data signal, and a first reverse bias transistor electrically connected between the gate terminal of the driving transistor and a first reverse bias voltage source. The method for aging the OLED display device includes: aging an organic light emitting diode, applying the same voltage to both of a first power supply voltage line, which is electrically connected to a first electrode of a driving transistor, and a second power supply voltage line, which is electrically connected to a second electrode of the organic light emitting diode, and applying a third reverse bias voltage to a gate terminal of the driving transistor.

18 Claims, 6 Drawing Sheets

U.S. PATENT DOCUMENTS

| | | | | |
|---|---|---|---|---|
| 2005/0030264 | A1* | 2/2005 | Tsuge et al. | 345/76 |
| 2005/0134189 | A1* | 6/2005 | Osame et al. | 315/169.1 |
| 2005/0140600 | A1* | 6/2005 | Kim et al. | 345/76 |
| 2006/0007072 | A1* | 1/2006 | Choi et al. | 345/76 |
| 2006/0044229 | A1* | 3/2006 | Yamazaki et al. | 345/76 |
| 2006/0187154 | A1* | 8/2006 | Tsuchida | 345/76 |
| 2006/0232520 | A1* | 10/2006 | Park et al. | 345/76 |
| 2006/0274012 | A1* | 12/2006 | Hong et al. | 345/95 |
| 2007/0030219 | A1* | 2/2007 | Park et al. | 345/76 |
| 2007/0075938 | A1* | 4/2007 | Sung et al. | 345/76 |
| 2007/0126666 | A1* | 6/2007 | Yamazaki et al. | 345/76 |
| 2007/0164938 | A1* | 7/2007 | Shin et al. | 345/76 |
| 2008/0094320 | A1* | 4/2008 | Parikh et al. | 345/76 |
| 2008/0252573 | A1* | 10/2008 | Fish et al. | 345/80 |

FOREIGN PATENT DOCUMENTS

| | | |
|---|---|---|
| KR | 10-2004-0078847 | 9/2004 |
| KR | 10-2005-0122983 | 12/2005 |
| KR | 10-2006-0016588 | 2/2006 |

* cited by examiner

ORGANIC LIGHT EMITTING DIODE DISPLAY DEVICE AND METHOD OF AGING THE SAME

CLAIM OF PRIORITY

This application makes reference to, incorporates the same herein, and claims all benefits accruing under 35 U.S.C. §119 from an application for ORGANIC LIGHT EMITTING DIODE DISPLAY DEVICE AND AGING METHOD OF THE SAME earlier filed in the Korean Intellectual Property Office on 1 Feb. 2007 and there duly assigned Serial No. 10-2007-0010514.

BACKGROUND OF THE INVENTION

1. Field of the Invention

The present invention relates to an organic light emitting diode (OLED) display device and a method for aging the OLED display device, and more particularly, to an OLED display device and a method for aging the same in which a driving transistor is electrically aged so that the efficiency of the driving transistor is increased to compensate for a lowering of efficiency due to the aging of an organic light emitting diode.

2. Description of the Related Art

A flat panel display device (FPD) has been employed as a display device to replace a cathode-ray tube (CRT) display device because the FPD is lightweight and thin. Typical examples of the FPD are a liquid crystal display device (LCD) and an organic light emitting diode (OLED) display device. In comparison with the LCD, the OLED display device is excellent in luminance and viewing angle and can be made ultrathin because the OLED display device does not need backlight.

The OLED display device is constructed with an organic layer having an organic emission layer, which is interposed between an anode and a cathode. Thus, when a voltage is applied between the anode and the cathode, electrons and holes recombine in the organic emission layer to produce excitons. As a result, light is generated due to the energy of the excitons.

The OLED display device may be classified into a passive matrix type and an active matrix type depending on the method for driving the OLED display. An active matrix type OLED display device is constructed with a circuit using a thin film transistor (TFT). A passive matrix type OLED display device can be fabricated by a simple process since anodes and cathodes are arranged in a matrix shape in a display region. The passive matrix type OLED display device, however, is only applicable to low-resolution small-sized display devices owing to the resolution limit, high driving voltage, and short lifetimes of materials.

In comparison, in the active matrix type OLED display device, a TFT is disposed in each pixel of a display region. Thus, a constant amount of current can be supplied to each pixel so that the active matrix type OLED display device can emit light with stable luminance. Also, since the active matrix type OLED display device consumes low power, the active matrix type OLED display device can be applied to high-resolution large-sized display devices.

An organic light emitting diode may deteriorate due to the usage of the OLED display device. Thus, a driving voltage varies and a lifetime of the OLED display device is shortened. In an initial period of operation, the lifetime of the OLED display device is shortened at a higher rate so that the driving voltage of the OLED display device greatly varies. After a certain period of operation, the lifetime of the OLED display device is shortened at a lower rate, and the OLED display device can be stably driven. Therefore, the contemporary organic light emitting diode (OLED) is intentionally degraded to a certain level using an aging process in order to decrease the initial failure rate of the OLED display device and increase the lifetime of the OLED display device.

The process for aging the OLED, however, may lead to a lowering of efficiency so that the luminance of the OLED display device deteriorates. Therefore, the driving voltage of the OLED display device needs to be increased in order to compensate for the poor luminance of the OLED display device. In this case, the entire power consumption increases.

SUMMARY OF THE INVENTION

It is therefore an object of the present invention to provide an improved organic light emitting diode (OLED) display device.

It is another object to provide an improved method for aging the OLED display device in which the efficiency of a driving transistor is increased to compensate for a lowering of efficiency due to the aging of an OLED, so that an initial failure rate can be reduced without increasing the driving voltage and power consumption of the OLED display device, and the lifetime of the OLED display device can be extended.

In one aspect of the present invention, an OLED display device is constructed with an organic light emitting diode, a scan line for applying a scan signal, a data line for applying a data signal, a driving unit for applying the data signal in response to the scan signal, a driving transistor having a gate terminal electrically connected to the driving unit to supply a driving current to the organic light emitting diode in response to the data signal, and a first reverse bias transistor electrically connected between the gate terminal of the driving transistor and a first reverse bias voltage source.

In another aspect of the present invention, a method for aging an OLED display device contemplates aging an organic light emitting diode, applying the same voltage to both of a first power supply voltage line, which is electrically connected to a first electrode of a driving transistor, and a second power supply voltage line, which is electrically connected to a second electrode of the organic light emitting diode, and applying a third reverse bias voltage to a gate terminal of the driving transistor.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
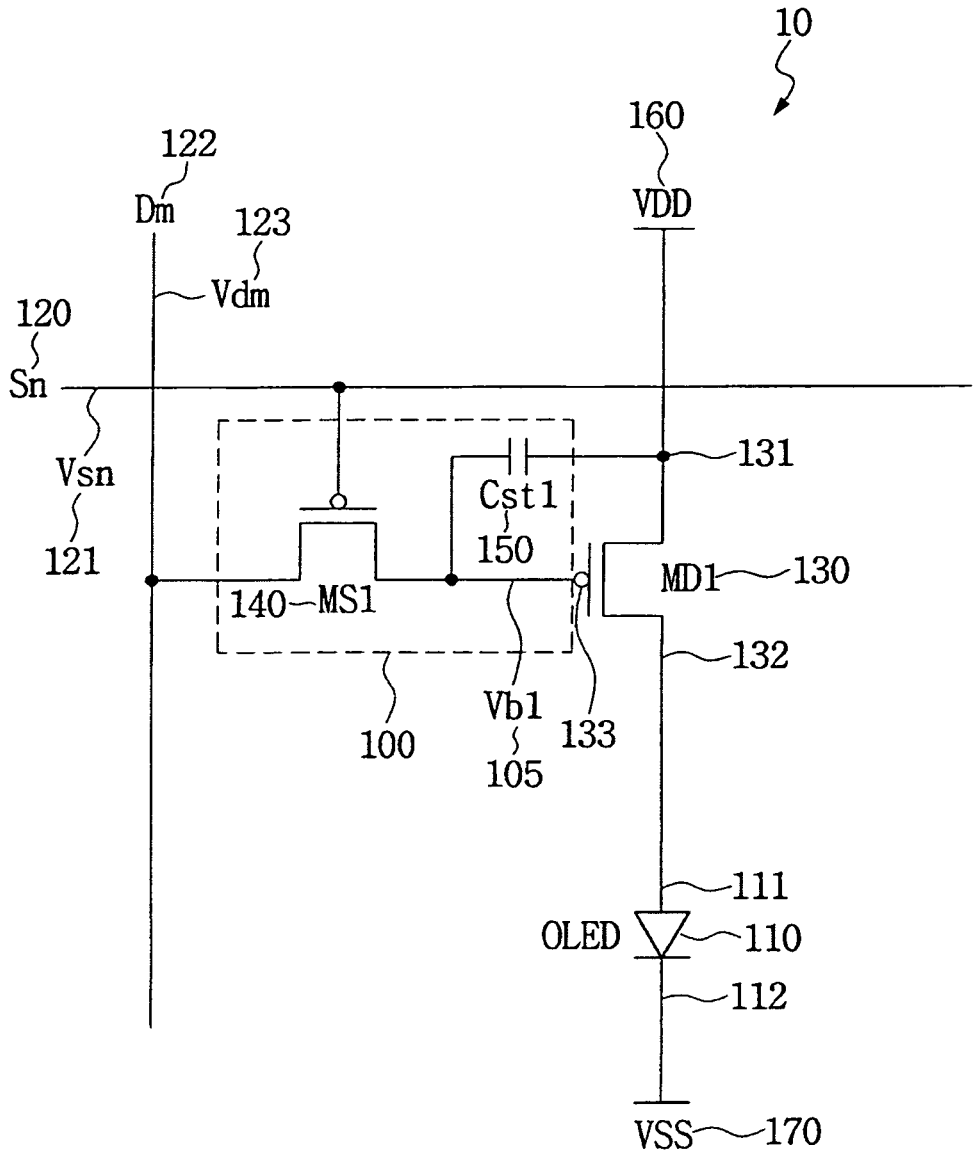
FIG. 1 is a circuit diagram of a pixel circuit of an organic light emitting diode (OLED) display device according to a first embodiment of the principles of the present invention.

The present invention will now be described more fully hereinafter with reference to the accompanying drawings, in which exemplary embodiments of the invention are shown. In the drawings, the thicknesses of layers and regions are exaggerated for clarity. The same reference numerals are used to denote the same elements throughout the specification. It will also be understood that when an element is referred to as being "connected to" another element, it can be directly connected to the other element or electrically connected to the other element by interposing a third element therebetween.

FIG. 1 is a circuit diagram of a pixel circuit of an organic light emitting diode (OLED) display device according to a first exemplary embodiment of the principles of the present invention.

Referring to FIG. 1, pixel circuit 10 of the OLED display device includes an organic light emitting diode OLED 110, a scan line Sn 120 for applying a scan signal Vsn 121, a data line Dm 122 for applying a data signal Vdm 123, a driving transistor MD1 130 for supplying a driving current to OLED 110 in response to data signal Vdm 123, and a driving unit 100 for applying data signal Vdm 123 to a gate terminal 133 of driving transistor MD1 130 in response to scan signal Vsn 121.

Driving unit 100 is constructed with a switching transistor MS1 140 and a capacitor Cst1 150. Switching transistor MS1 140 is turned on in response to scan signal Vsn 121 and applies data signal Vdm 123 to gate terminal 133 of driving transistor MD1 130. Capacitor Cst1 150 is electrically connected between switching transistor MS1 140 and a first power supply voltage line VDD 160. Capacitor Cst1 150 stores data signal Vdm 123 and continuously applies data signal Vdm 123 to gate terminal 133 of driving transistor MD1 130 until a new data signal is applied in response to a next scan signal. Each of driving transistor MD1 130 and switching transistor MS1 140 may be either one of a P-channel metal oxide semiconductor (PMOS) transistor and an N-channel metal oxide semiconductor (NMOS) transistor. Driving transistor MD1 130 and switching transistor MS1 140 may be of the same type of conductivity. That is, both of driving transistor MD1 130 and switching transistor MS1 140 may be either PMOS transistors or NMOS transistors.

Although not shown in the drawings, driving unit 100 may further include a compensation circuit including a plurality of transistors or an initialization line and an initialization transistor for preventing luminance nonuniformity caused by the remaining current of capacitor Cst1 150 in order to inhibit a variation of the driving current supplied to OLED 110 due to the varying characteristics of driving transistor MD1.

A method for aging the OLED display device according to the first embodiment of the present invention is performed in order to ensure the stable characteristics of the organic light emitting diode OLED and inhibit the occurrence of initial failures.

Contemporarily, methods for aging the OLED may be largely classified into a thermal aging method and an electrical aging method. Specifically, the thermal aging method contemplates heating the OLED at a constant temperature in a vacuum state that does not affect the OLED, or at a moisture level of 10 parts per million (ppm) or lower so that thermal stress is applied to the OLED. The electrical aging method contemplates applying a reverse bias voltage to the organic light emitting diode OLED so that electrical stress is applied to the organic light emitting diode OLED. In the case of the OLED display device constructed as the first exemplary embodiment according to the principles of the present invention, either of voltage VDD applied to first power supply voltage line VDD 160, which is electrically connected to a first electrode 110 of OLED 110, or voltage VSS applied to second power supply voltage line VSS 170, which is electrically connected to a second electrode 112 of OLED 110, may be controlled, and scan signal Vsn 121 and data signal Vdm 123 may be respectively applied to scan line Sn 120 and data line Dm 122 so that OLED 110 can be electrically aged. Alternatively, the OLED display device including OLED 110 may be loaded in a chamber and heated so that the organic light emitting diode OLED can be thermally aged.

After the aging process of OLED 110, driving transistor MD1 130 is aged. Specifically, a voltage V1 is applied to both first power supply voltage line VDD 160, which is electrically connected to a first electrode 131 of driving transistor MD1 130, and second power supply voltage line VSS 170, which is electrically connected to second electrode 112 of OLED 110. Thus, when a channel is subsequently formed due to a first reverse bias voltage Vb1 105 applied to gate terminal 133 of driving transistor MD1 130, a driving current can be prevented from being applied to OLED 110.

In order for first reverse bias voltage Vb1 105 applied to gate terminal 133 of driving transistor MD1 130 to be easily controlled, a voltage V1 which is applied to both the first power supply voltage line VDD 160 and the second power supply voltage line VSS 170 can be set to be equal to either VSS which is relatively lower in magnitude than VDD and which is applied to second power supply voltage line VSS 170 during normal operation, or VDD which is relatively higher in magnitude than VSS and which is applied to first power supply voltage line VDD 160 during normal operation depending on the type of conductivity of driving transistor MD1 130. Normal operation refers to a driving condition of the OLED for faithfully displaying a predetermined image after completion of an aging process. More specifically, when driving transistor MD1 130 is a PMOS transistor as illustrated in FIG. 1, first reverse bias voltage Vb1 105 applied to gate terminal 133 of driving transistor MD1 130 may be higher than the voltage applied to first electrode 131 of driving transistor MD1 130. Therefore, Vi is set to be equal to VSS which is applied to second power supply voltage line VSS 170 during normal operation. That is, second power supply voltage VSS, which is lower than first power supply voltage VDD during normal operation, is applied to first electrode 131 of driving transistor MD1 130, and thereby first reverse bias voltage Vb1 105 can be easily controlled to be a lower voltage than in a case where Vi, which is applied to first electrode 131 of driving transistor MD1 130, is set to be equal to VDD which is applied to first power supply voltage line VDD 160 during normal operation.

Subsequently, switching transistor MS1 140 is turned on in response to scan signal Vsn 121 and applies a first reverse bias voltage Vb1 105 through data line Dm 122 to gate terminal 133 of driving transistor MD1 130. First reverse bias voltage Vb1 105, which is required to electrically age driving transistor MD1 130, may be higher than voltage V1 applied through first power supply voltage line VDD 160 to first electrode 131 of driving transistor MD1 130. In order to efficiently perform an electrical aging process on driving transistor MD1 130, first reverse bias voltage Vb1 105 may be an alternating voltage. In the current embodiment of the present invention, since driving transistor MD1 130 is a PMOS transistor, first reverse bias voltage Vb1 105 is higher than the voltage applied to first electrode 131 of driving transistor MD1 130. When the driving transistor MD1 is an NMOS transistor, however, first reverse bias voltage Vb1 105 may be lower than the voltage applied to first electrode 131 of driving transistor MD1 130.

Figure 2A:
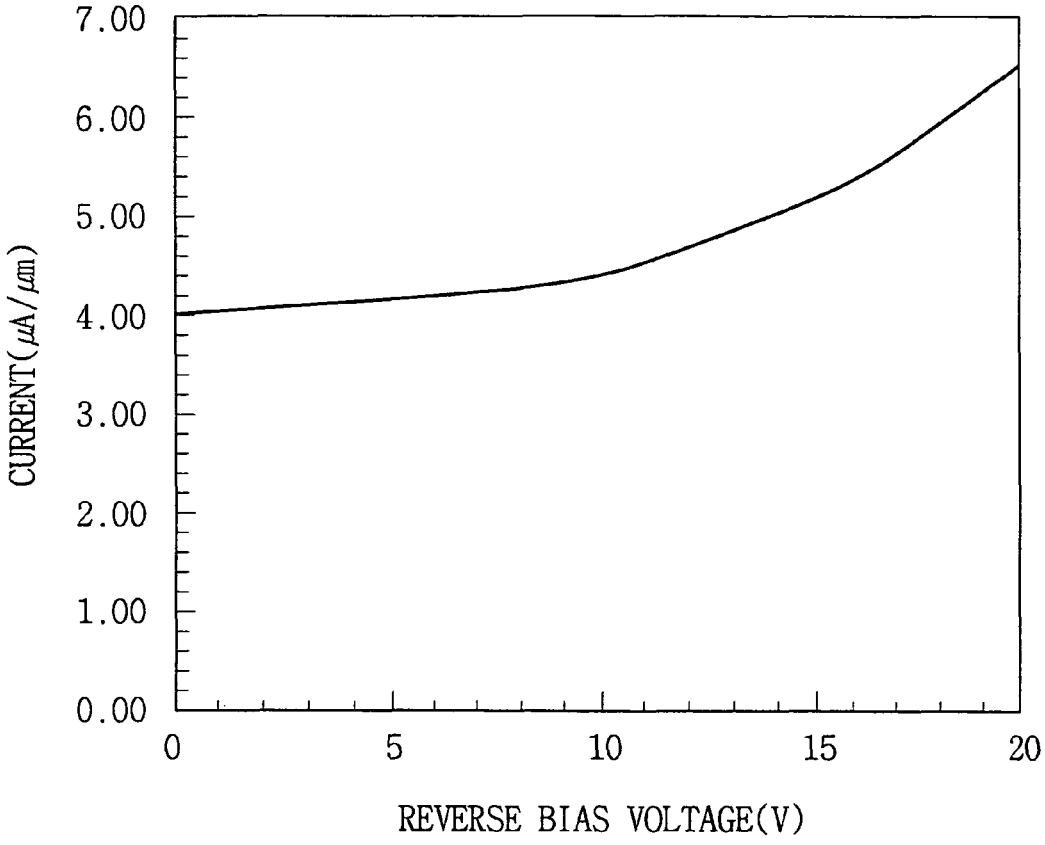
FIG. 2A is a graph showing of an output current of a driving transistor with respect to a reverse bias voltage applied to a gate terminal of the driving transistor.
Figure 2B:
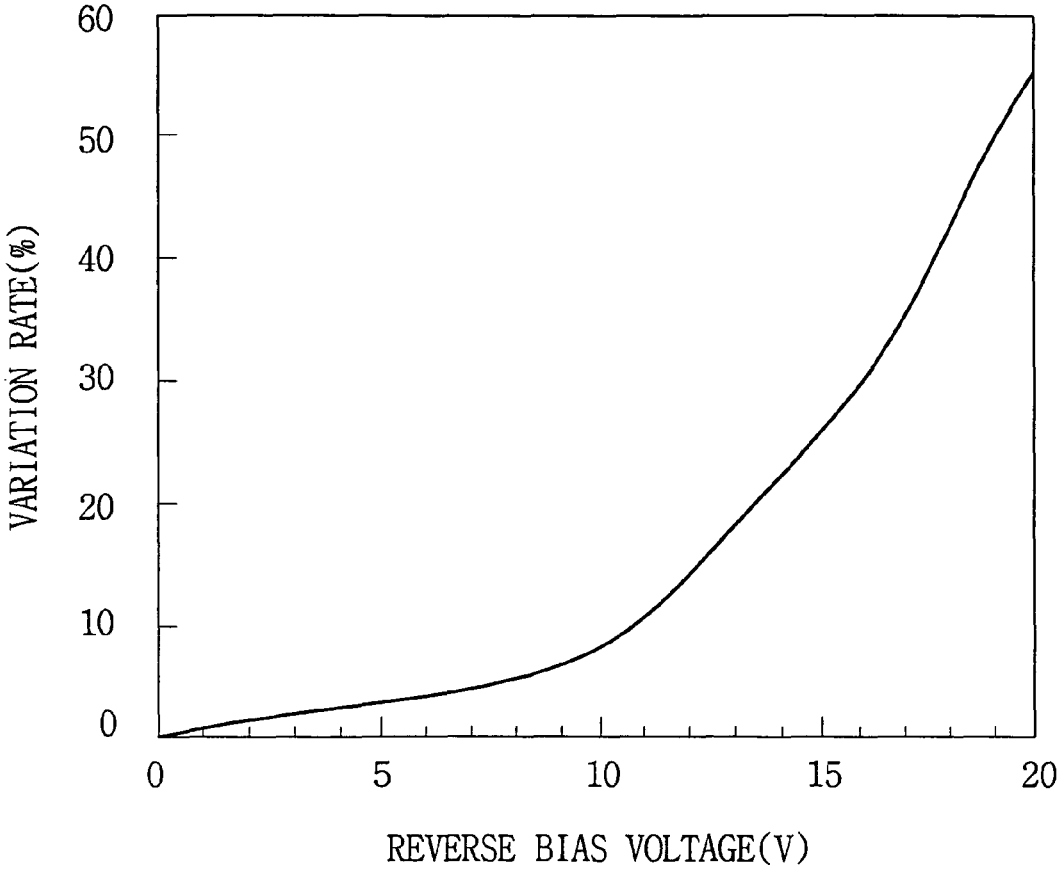
FIG. 2B is a graph showing a variation rate of the output current of the driving transistor with respect to the reverse bias voltage applied to the gate terminal of the driving transistor.

FIG. 2A is a graph showing of an output current of driving transistor MD1 130 with respect to reverse bias voltage Vb1 105 applied to gate terminal 133 of driving transistor MD1 130; FIG. 2B is a graph showing a variation rate of the output current of driving transistor MD1 130 with respect to reverse bias voltage Vb1 105 applied to gate terminal 133 of driving transistor MD1 130; and FIG. 3 is a graph showing a threshold voltage of driving transistor MD1 130 with respect to reverse bias voltage Vb1 105 applied to gate terminal 133 of driving transistor MD1 130.

Referring to FIG. 2A, when reverse bias voltage Vb1 105 which is applied to gate terminal 133 of PMOS driving transistor MD1 130, increases during an aging process of an OLED display device, the output current of driving transistor MD1 130 increases. Also, referring to FIG. 2B, it can be seen that as reverse bias voltage Vb1 105 increases, a variation rate of the output current of driving transistor MD1 130 also increases.

Figure 3:
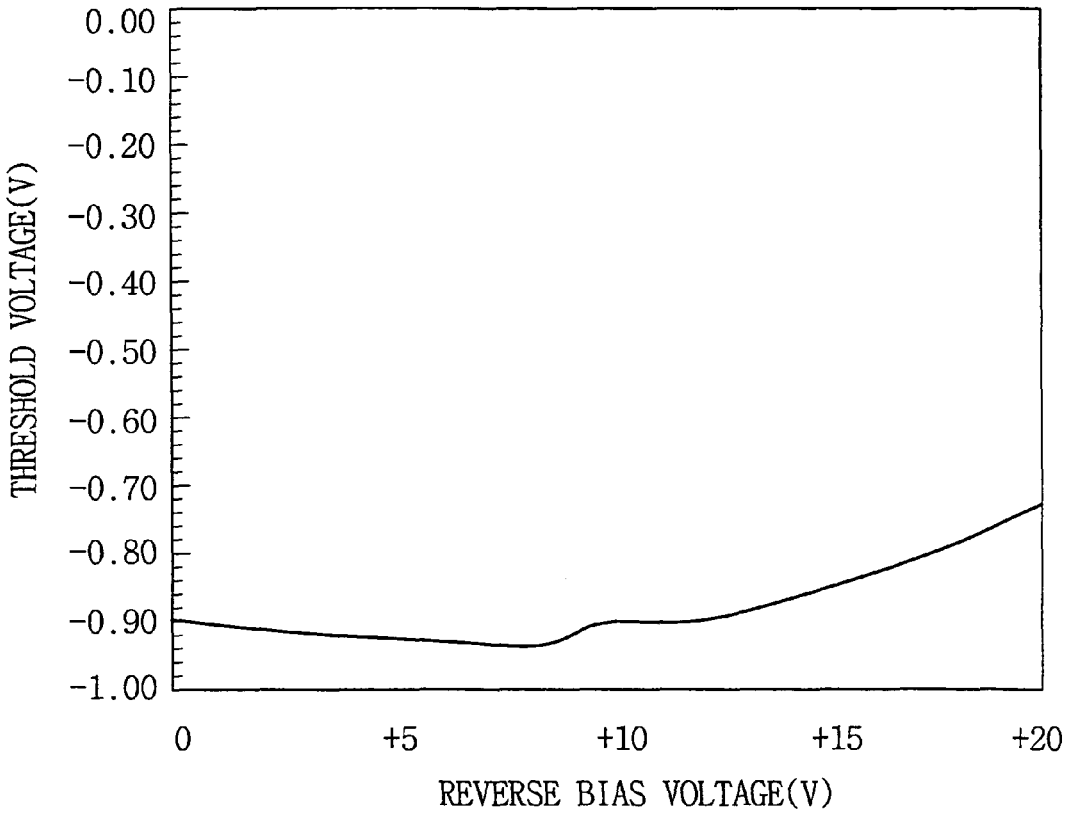
FIG. 3 is a graph showing a threshold voltage of the driving transistor with respect to the reverse bias voltage applied to the gate terminal of the driving transistor.

Referring to FIG. 3, however, when reverse bias voltage Vb1 105 applied to gate terminal 133 of driving transistor MD1 130 increases during the aging process of the OLED display device, the threshold voltage of driving transistor MD1 130 also increases. Therefore, when a high voltage is applied as reverse bias voltage Vb1 105, the threshold voltage of driving transistor MD1 130 also notably increases so that the entire power consumption may increase.

For this reason, a reverse bias voltage applied to a gate terminal of a PMOS driving transistor during an aging process of an OLED display device may be higher by approximately 5 V to approximately 20 V than the voltage applied to first electrode 131 of driving transistor MD1 130 such that a variation rate of current of the driving current is 5% or higher and the threshold voltage of driving transistor MD1 130 is −0.7 V or lower. Similarly, a reverse bias voltage applied to a gate terminal of an NMOS driving transistor during an aging process of an OLED display device may be lower by approximately 5 V to approximately 20 V than the voltage applied to first electrode 131 of driving transistor MD1 130.

In conclusion, in the OLED display device according to the first exemplary embodiment of the present invention, the organic light emitting diode and the driving transistor are aged by controlling a voltage applied through the first power supply voltage line, which is electrically connected to the first electrode of the driving transistor, and the second power supply voltage line, which is electrically connected to the second electrode of the organic light emitting diode, and a voltage applied through the data line without using any additional element. Thus, a lowering of efficiency caused by the aging of the organic light emitting diode can be compensated for.

Figure 4:
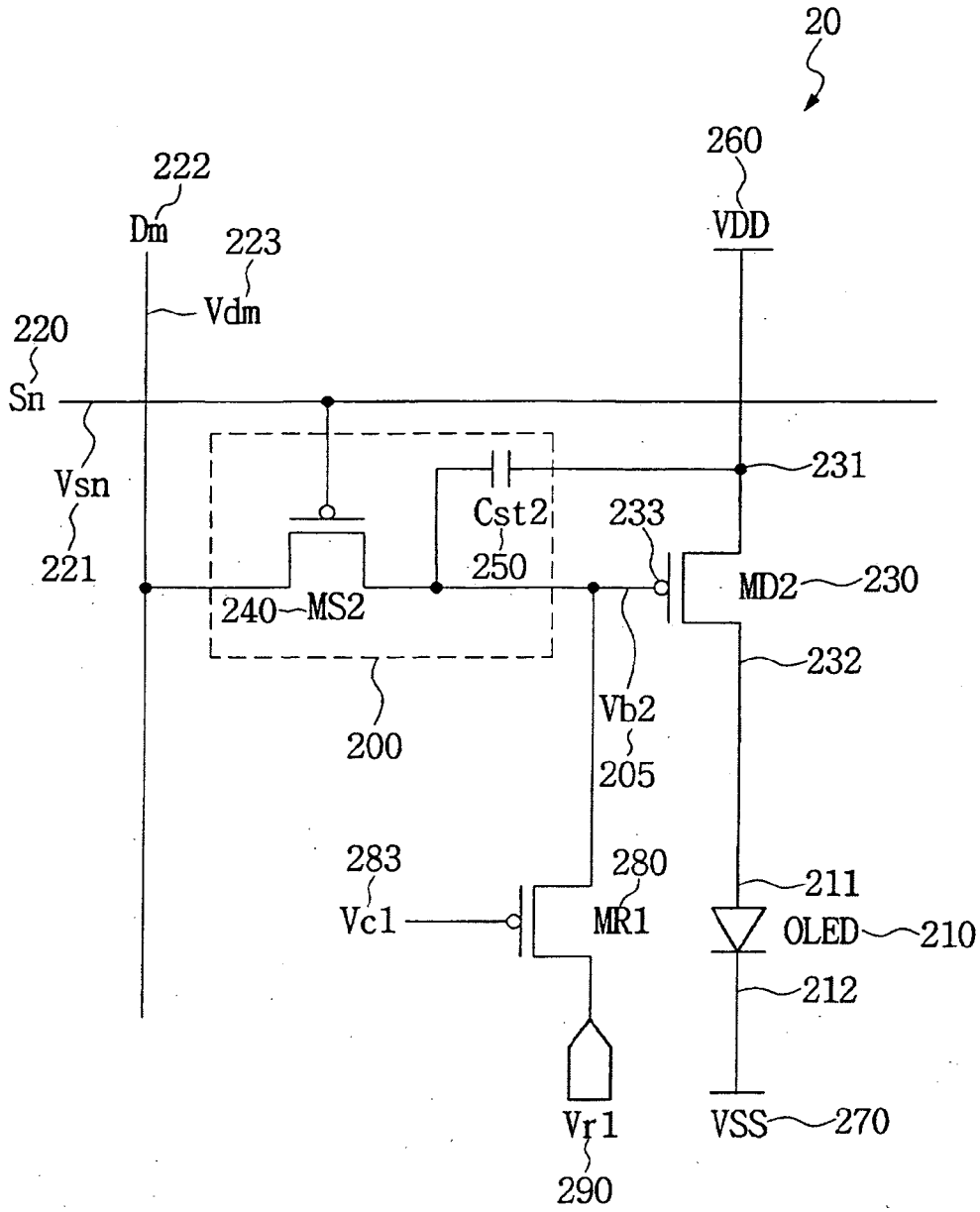
FIG. 4 is a circuit diagram of a pixel circuit of an OLED display device according to a second embodiment of the principles of the present invention.

FIG. 4 is a circuit diagram of a pixel circuit of an OLED display device according to a second embodiment of the principles of the present invention.

Referring to FIG. 4, pixel circuit 20 of the OLED display device includes an organic light emitting diode OLED 210, a scan line Sn 220 for applying a scan signal Vsn 221, a data line Dm 222 for applying a data signal Vdm 223, a driving transistor MD2 230 for supplying a driving current to OLED 210 in response to data signal Vdm 223, a driving unit 200 for applying data signal Vdm 223 to a gate terminal 233 of driving transistor MD 230 in response to scan signal Vsn 221, and a second reverse bias transistor MR1 280 electrically connected between gate terminal 233 of driving transistor MD2 230 and a second reverse bias voltage source Vr1 290.

Driving unit 200 includes a switching transistor MS2 240 and a capacitor Cst2 250. Switching transistor MS2 240 is turned on in response to scan signal Vsn 221 and applies data signal Vdm 223 to gate terminal 233 of driving transistor MD2 230. Capacitor Cst2 250 is electrically connected between switching transistor MS2 240 and a first power supply voltage line VDD 260. Capacitor Cst2 250 stores data signal Vdm 223 and continuously applies data signal Vdm 223 to gate terminal 233 of driving transistor MD2 230 until a new data signal is applied in response to a next scan signal. Each of driving transistor MD2 230, switching transistor MS2 240, and second reverse bias transistor MR1 280 may be any one of a PMOS transistor and an NMOS transistor. Driving transistor MD2 230, switching transistor MS2 240, and second reverse bias transistor MR2 280 may be of the same type of conductivity.

Second reverse bias transistor MR1 280 is turned on in response to a second reverse control signal Vc1 283 and applies a second reverse bias voltage Vb2 205 to gate terminal 233 of driving transistor MD2 230. In this case, second reverse bias transistor MR1 280 may have a different conductivity type from switching transistor MS2 240 such that second reverse bias voltage Vb2 205 applied to gate terminal 233 of driving transistor MD2 230 has an opposite polarity to a voltage of data signal Vdm 223 applied in a normal operation.

A method for aging the OLED display device according to the second embodiment of the principles of the present invention will now be described. At first, either one of voltage VDD applied to first power supply voltage line VDD 260, which is electrically connected to a first electrode 211 of OLED 210, or voltage VSS applied to second power supply voltage line VSS 270, which is electrically connected to a second electrode 212 of OLED 210, is controlled, and scan signal Vsn 221 and data signal Vdm 223 are respectively applied to scan line Sn 220 and data line Dm 222 so that OLED 210 can be electrically aged. Alternatively, the OLED display device including OLED 210 may be loaded in a chamber and heated so that the OLED can be thermally aged.

After the aging process of the OLED, driving transistor MD2 230 is aged. A voltage V1 is applied to both first power supply voltage line VDD 260, which is electrically connected to first electrode 231 of driving transistor MD2 230, and second power supply voltage line VSS 270, which is electrically connected to second electrode 212 of OLED 210. Thus, when a channel is subsequently formed due to second reverse bias voltage Vb2 205 applied to gate terminal 233 of driving transistor MD2 230, a driving current can be prevented from being applied to the OLED.

Also, voltage Vb2 205 applied to gate terminal 233 of driving transistor MD2 230 can be easily controlled by setting voltage V1 to be equal to either VSS which is applied to second power supply voltage line VSS 270 and which is relatively lower than VDD during normal operation, or VDD which is applied to first power supply voltage line VDD 260 and which is relatively higher than VSS during normal operation, depending on the type of conductivity of the driving transistor MD2. More specifically, when driving transistor MD2 230 is a PMOS transistor as illustrated in FIG. 2, second reverse bias voltage Vb2 205 applied to gate terminal 233 of driving transistor MD2 230 should be higher than a voltage applied to first electrode 231 of driving transistor MD2 230. Therefore, voltage V1 is set to be equal to VSS which is applied to second power supply voltage line VSS 270 during normal operation. When voltage VSS is applied to first electrode 231 of driving transistor MD2 230, second reverse bias voltage Vb2 205 can be easily controlled to be a lower voltage than in a case where voltage VDD which is applied to first power supply voltage line VDD 260 during normal operation, is applied to first electrode 231 of driving transistor MD2 230.

Subsequently, second reverse bias transistor MR1 280 is turned on in response to second reverse bias control signal Vc1 283 and applies second reverse bias voltage Vb2 205 to gate terminal 233 of driving transistor MD2 230. Second reverse bias voltage Vb2 205 may be higher than voltage V1 applied through first power supply voltage line VDD 260 to first electrode 231 of driving transistor MD2 230. As described above with reference to FIGS. 2A, 2B, and 3, second reverse bias voltage Vb2 205 may be higher by approximately 5 V to approximately 20 V than the voltage applied to first electrode 231 of driving transistor MD2 230. In the current embodiment of the present invention, it is assumed that driving transistor MD2 230 is a PMOS transistor. When driving transistor MD2 230 is an NMOS transistor, however, second reverse bias voltage VG2 may be lower by approximately 5 V to approximately 20 V than the voltage applied to first electrode 231 of driving transistor MD2 230.

In conclusion, in the OLED display device according to the second exemplary embodiment of the principles of the present invention, the organic light emitting diode and the driving transistor are aged by applying a second reverse bias voltage to the driving transistor through the second reverse bias transistor electrically connected between the second reverse bias voltage source and the gate terminal of the driving transistor. Thus, power consumed during the aging process of the OLED display device can be markedly reduced.

Figure 5:
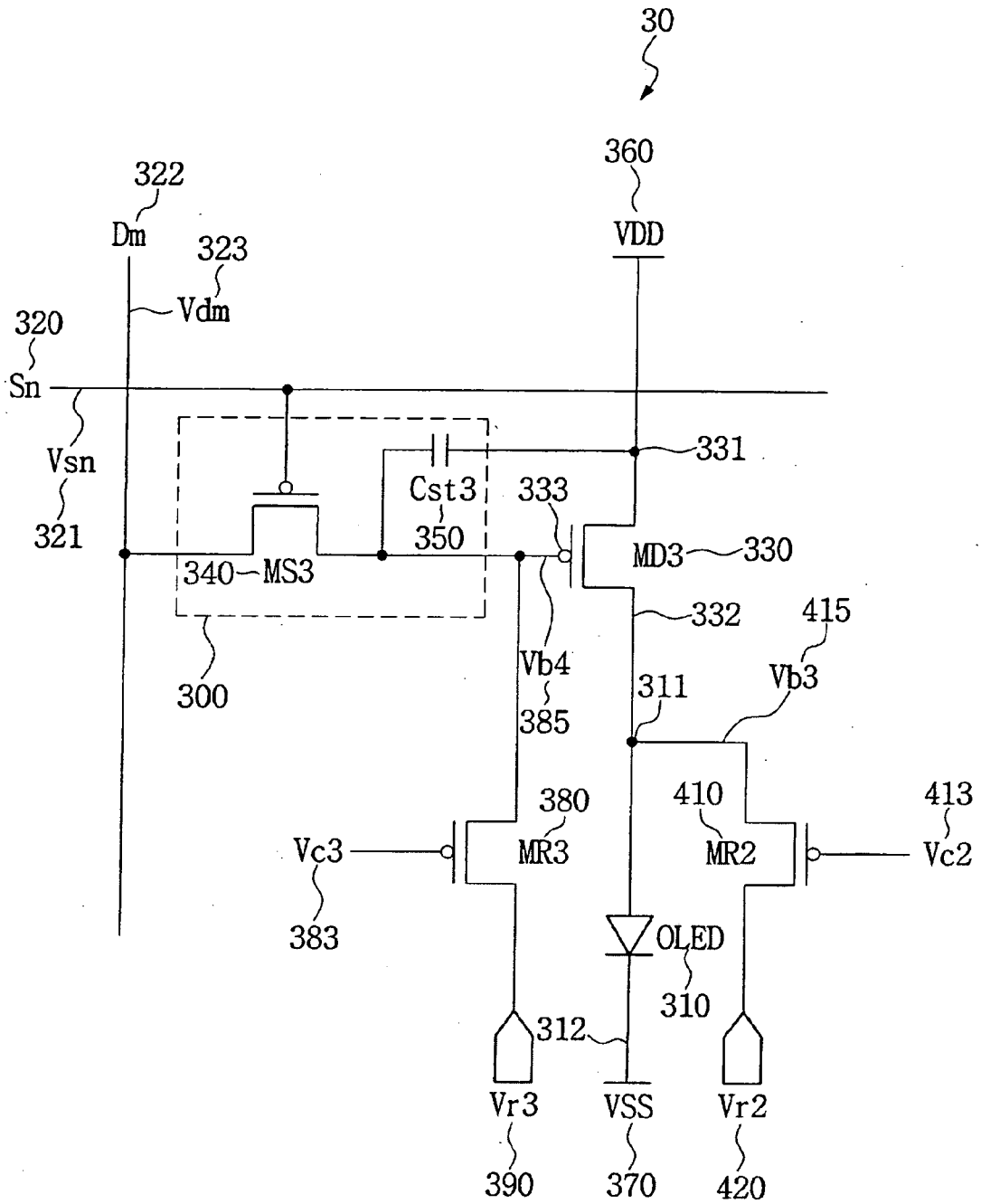
FIG. 5 is a circuit diagram of a pixel circuit of an OLED display device according to a third embodiment of the principles of the present invention.

FIG. 5 is a circuit diagram of a pixel circuit of an OLED display device according to a third exemplary embodiment of the principles of the present invention.

Referring to FIG. 5, pixel circuit 30 of the OLED display device includes an organic light emitting diode OLED 310, a scan line Sn 320 for applying a scan signal Vsn 321, a data line Dm 322 for applying a data signal Vdm 323, a driving transistor MD3 330 for supplying a driving current to OLED 310 in response to data signal Vdm 323, a driving unit 300 for applying data signal Vdm 323 to a gate terminal 333 of driving transistor MD3 330 in response to scan signal Vsn 321, a third reverse bias transistor MR2 410 electrically connected between OLED 310 and a third reverse bias voltage source Vr2 420, and a fourth reverse bias transistor MR3 380 electrically connected between gate terminal 333 of driving transistor MD3 330 and a fourth reverse bias voltage source Vr3 390.

Driving unit 300 includes a switching transistor MS3 340 and a capacitor Cst3 350. Switching transistor MS3 340 is turned on in response to scan signal Vsn 321 and applies data signal Vdm 323 to gate terminal 333 of driving transistor MD3 330. Capacitor Cst3 350 is electrically connected between switching transistor MS3 340 and a first power supply voltage line VDD 360. Capacitor Cst3 350 stores data signal Vdm 323 and continuously applies data signal Vdm 323 to gate terminal 333 of driving transistor MD3 330 until a new data signal is applied in response to a next scan signal. Each of driving transistor MD3 330, switching transistor MS3 340, third reverse bias transistor MR2 410, and fourth reverse bias transistor MR3 380 may be any one of a PMOS transistor and an NMOS transistor. Driving transistor MD3 330, switching transistor MS3 340, third reverse bias transistor MR2 410, and fourth reverse bias transistor MR3 380 may be of the same type of conductivity.

Third reverse bias transistor MR2 410 is turned on in response to a third reverse control signal Vc2 413 and applies a third reverse bias voltage Vb3 415 to OLED 310. As illustrated in FIG. 5, third reverse bias transistor MR2 410 may be electrically connected between a first electrode 311 of OLED 310, which is electrically connected to a second electrode 332 of driving transistor MD3 330, and third reverse bias voltage source Vr2 420. Alternatively, third reverse bias transistor MR2 410 may be electrically connected between a second electrode 312 of OLED 310, which is electrically connected to a second power supply voltage line VSS 370, and third reverse bias voltage source Vr2 420.

Fourth reverse bias transistor MR3 380 is electrically connected between gate terminal 333 of driving transistor MD3 330 and fourth reverse bias voltage source Vr3 390, is turned on in response to a fourth reverse control signal Vc3 383, and applies a fourth reverse bias voltage Vb4 385 to gate terminal 333 of driving transistor MD3 330. In this case, fourth reverse bias transistor MR3 380 may have a different conductivity type from switching transistor MS3 340 such that fourth reverse bias voltage Vb4 385 applied to gate terminal 333 of driving transistor MD3 330 has an opposite polarity to a voltage of data signal Vdm 323 applied in a normal operation.

A method for aging the OLED display device according to the third embodiment of the principles of the present invention will now be described. At first, a process for aging OLED 310 is performed. Specifically, third reverse bias transistor MR2 410 is turned on in response to third reverse bias control signal Vc2 413 and applies third reverse bias voltage Vb3 415 to first electrode 311 of OLED 310. Third reverse bias voltage Vb3 415 may be lower than voltage VSS applied through second power supply voltage line VSS 370 that is electrically connected to second electrode 312 of OLED 310. In order to efficiently perform an aging process, third reverse bias voltage Vb3 415 may range from approximately −14 V to approximately −10 V.

Subsequently, a process for aging driving transistor MD3 330 is performed. Specifically, fourth reverse bias transistor MR3 380 is turned on in response to a fourth reverse 11 bias control signal Vc3 383 and applies fourth reverse bias voltage Vb4 385 to gate terminal 333 of driving transistor MD3 330. Fourth reverse bias voltage Vb4 385 may be higher than voltage VDD applied through first power supply voltage line VDD 360 to first electrode 331 of driving transistor MD3 330. As described above with reference to FIGS. 2A, 2B, and 3, fourth reverse bias voltage Vb4 385 may be higher by approximately 5 V to 20 V than the voltage applied to first electrode 331 of driving transistor MD3 330. In the current embodiment of the present invention, it is assumed that driving transistor MD3 330 is a PMOS transistor. When the driving transistor MD3, however, is an NMOS transistor, fourth reverse bias voltage Vb4 385 may be lower by approximately 5 V to approximately 20 V than the voltage applied to first electrode 311 of driving transistor MD3 330.

In conclusion, in the OLED display device according to the third exemplary embodiment of the present invention, the organic light emitting diode and the driving transistor are electrically aged using the third reverse bias voltage source, the third reverse bias transistor, the fourth reverse bias voltage source, and the fourth reverse bias transistor without driving the OLED display device. Thus, power consumed during the aging process of the OLED display device can be markedly reduced, and a process of loading the OLED display device in a chamber to thermally age the organic light emitting diode may be omitted, thereby simplifying the entire aging process.

As explained thus far, in an OLED display device according to the present invention, a reverse bias voltage is applied to a gate terminal of a driving transistor so that the driving transistor can be electrically aged. Thus, a lowering of efficiency due to the aging of an organic light emitting diode can be compensated for. As a result, the lifetime of the OLED display device can be extended without increasing a driving voltage and power consumption, and the initial failure rate of the OLED display device can be reduced.

Although the present invention has been described with reference to certain exemplary embodiments thereof, it will be understood by those skilled in the art that a variety of modifications and variations may be made to the present invention without departing from the spirit or scope of the present invention defined in the appended claims, and their equivalents.

What is claimed is:

1. An organic light emitting diode (OLED) display device, comprising:

an organic light emitting diode;

a scan line for applying a scan signal;

a data line for applying a data signal;

a driving unit for applying the data signal in response to the scan signal;

a driving transistor having a gate terminal electrically connected to the driving unit to supply a driving current to the organic light emitting diode in response to the data signal, the driving transistor being a P-channel metal oxide semiconductor (PMOS) transistor; and a first reverse bias transistor electrically connected between the gate terminal of the driving transistor and a first reverse bias voltage source, with the first reverse bias transistor being turned on in response to a first reverse bias control signal and applies a first reverse bias voltage to the gate terminal of the driving transistor, the first reverse bias voltage being higher by approximately 5 V to approximately 20 V than a voltage Vi applied to a source electrode of the driving transistor, the first reverse bias transistor being turned on and the first reverse bias voltage being applied to the gate terminal of the driving transistor only during an aging process that occurs upon manufacture of the display device and not during normal operation during normal drive cycles of the display device when images are being displayed.

2. The OLED display device according to claim 1, further comprising a second reverse bias transistor electrically connected between the organic light emitting diode and a second reverse bias voltage source.

3. The OLED display device according to claim 2, with the second reverse bias transistor being electrically connected between a first electrode of the organic light emitting diode, which is electrically connected to an electrode of the driving transistor, and the second reverse bias voltage source.

4. The OLED display device according to claim 2, with the second reverse bias transistor being turned on in response to a second reverse bias control signal and applies a second reverse bias voltage to the organic light emitting diode.

5. The OLED display device according to claim 4, with the second reverse bias voltage ranging from approximately −14 V to approximately −10 V.

6. The OLED display device according to claim 2, with the driving unit comprising:

a switching transistor for applying the data signal to the gate terminal of the driving transistor in response to the scan signal; and a capacitor for storing the data signal applied from the switching transistor.

7. The OLED display device according to claim 6, with the switching transistor having a different conductivity type from the first reverse bias transistor.

8. A method for aging an organic light emitting diode (OLED) display device, comprising:

aging an organic light emitting diode by reverse biasing the organic light emitting diode; and then aging a driving transistor by applying a voltage Vi to both of a first power supply voltage line, which is electrically connected to a first electrode of the driving transistor, and a second power supply voltage line, which is electrically connected to a second electrode of the organic light emitting diode, with a second electrode of the driving transistor being electrically connected to a first electrode of the organic light emitting diode; and applying a first reverse bias voltage to a gate terminal of the driving transistor, with the first reverse bias voltage being higher by approximately 5 V to approximately 20 V than the voltage Vi applied to the first electrode of the driving transistor, wherein the aging of the organic light emitting diode and the driving transistor occurring upon manufacture of the display device and not during normal operation during normal drive cycles of the display device when images are being displayed.

9. The method according to claim 8, with the first reverse bias voltage being applied to the gate terminal of the driving transistor through a data line in response to a scan signal.

10. The method according to claim 9, with the first reverse bias voltage having an absolute value higher than that of the voltage Vi applied to the first electrode of the driving transistor through the first power supply voltage line.

11. A method for aging an organic light emitting diode (OLED) display device, comprising:

aging an organic light emitting diode by reverse biasing the organic light emitting diode; and then aging a driving transistor by applying a voltage Vi to both of a first power supply voltage line, which is electrically connected to a first electrode of the driving transistor, and a second power supply voltage line, which is electrically connected to a second electrode of the organic light emitting diode, with a second electrode of the driving transistor being electrically connected to a first electrode of the organic light emitting diode; and applying a first reverse bias voltage to a gate terminal of the driving transistor, with the first reverse bias voltage being higher by approximately 5 V to approximately 20 V than the voltage Vi applied to the first electrode of the driving transistor, with the first reverse bias voltage being applied to the gate terminal of the driving transistor through a data line in response to a scan signal, with the first reverse bias voltage being an alternating voltage, wherein the aging of the organic light emitting diode and the driving transistor occurring upon manufacture of the display device and not during normal operation during normal drive cycles of the display device when images are being displayed.

12. The method according to claim 8, with the first reverse bias voltage being applied by turning on a first reverse bias transistor electrically connected between the gate terminal of the driving transistor and a first reverse bias voltage source.

13. The method according to claim 12, with the first reverse bias voltage being higher than the voltage Vi applied to the first electrode of the driving transistor.

14. The method according to claim 13, with the first reverse bias voltage being higher by approximately 5 V to approximately 20 V than the voltage Vi applied to the first electrode of the driving transistor.

15. The method according to claim 8, with aging the organic light emitting diode being electrically performed by applying a second reverse bias voltage to the organic light emitting diode.

16. The method according to claim 15, with the second reverse bias voltage being applied by turning on a second reverse bias transistor electrically connected between a first electrode of the organic light emitting diode, which is electrically connected to a second electrode of the driving transistor, and a second reverse bias voltage source.

17. The method according to claim 15, with the second reverse bias voltage ranging from approximately −14 V to approximately −10 V.

18. The method of claim 8, the reverse biasing of the organic light emitting diode being accomplished by applying a second reverse bias voltage to a terminal of the organic light emitting diode.

* * * * *